US006872674B2

(12) United States Patent
Williams et al.

(10) Patent No.: US 6,872,674 B2
(45) Date of Patent: Mar. 29, 2005

(54) COMPOSITE STRUCTURES

(75) Inventors: Freddie Wayne Williams, Kingsport, TN (US); Eric Eugene Ellery, Kingsport, TN (US)

(73) Assignee: Eastman Chemical Company, Kingsport, TN (US)

( * ) Notice: Subject to any disclaimer, the term of this patent is extended or adjusted under 35 U.S.C. 154(b) by 185 days.

(21) Appl. No.: 10/245,213

(22) Filed: Sep. 17, 2002

(65) Prior Publication Data

US 2003/0124937 A1 Jul. 3, 2003

Related U.S. Application Data

(60) Provisional application No. 60/324,076, filed on Sep. 21, 2001.

(51) Int. Cl.[7] ..... D04H 1/54; D04H 3/14; D04H 1/00; D04H 13/00; D04H 3/00

(52) U.S. Cl. ..... 442/416; 442/409; 442/411; 442/415; 442/417

(58) Field of Search ..... 428/207, 373, 428/359, 171, 113, 191, 210, 296.7, 299.4, 300.4, 204; 442/409, 411, 415, 416, 360, 366–369, 327

(56) References Cited

U.S. PATENT DOCUMENTS

| | | | | |
|---|---|---|---|---|
| 2,012,267 A | | 8/1935 | Carothers | |
| 3,271,231 A | | 9/1966 | Moggio et al. | |
| 4,195,112 A | | 3/1980 | Sheard et al. | |
| 4,474,846 A | | 10/1984 | Doerer et al. | |
| 4,568,581 A | | 2/1986 | Peoples, Jr. | |
| 5,446,079 A | | 8/1995 | Buchanan et al. | |
| 5,692,527 A | * | 12/1997 | Matsumura et al. | 131/345 |
| 5,766,752 A | | 6/1998 | Cox et al. | |
| 5,883,025 A | | 3/1999 | Karstens et al. | |
| 5,922,451 A | | 7/1999 | Cox et al. | |
| 6,123,172 A | | 9/2000 | Byrd et al. | |
| 6,184,272 B1 | | 2/2001 | Foelster et al. | |
| 6,562,938 B2 | * | 5/2003 | Haile et al. | 528/271 |

FOREIGN PATENT DOCUMENTS

| | | |
|---|---|---|
| DE | 200 21 096 U1 | 4/2001 |

* cited by examiner

*Primary Examiner*—Cheryl A. Juska
*Assistant Examiner*—Lynda Salvatore
(74) *Attorney, Agent, or Firm*—B. J. Boshears; Bernard J. Graves, Jr.

(57) ABSTRACT

The present invention is a non-woven web or composite structure comprising (a) from about 50 to about 90 weight percent of a natural cellulose fiber; (b) from about 10 to about 50 weight percent of a binder fiber component; (c) from 0 to about 20 weight percent of a filler; and (d) from 0 to about 8 weight percent of a dye or pigment.

18 Claims, No Drawings

COMPOSITE STRUCTURES

RELATED APPLICATIONS

This application claims priority of provisional application U.S. Ser. No. 60/324,076, filed on Sep. 21, 2001.

FIELD OF THE INVENTION

This invention relates to articles of manufacture in the form of composite structures, and more particularly to such composite structures made of natural cellulose fibers that are useful for making panels and moldings.

BACKGROUND OF THE INVENTION

Currently composite structures containing natural cellulose fibers are used in the automotive industry for package trays, interior door trim, rear window shelves, seat backs, carpet backing, and acoustic insulation. Examples of articles of composite construction are disclosed in U.S. Pat. Nos. 4,474,846, 5,883,025, 6,123,172 and 6,184,272. Other uses for composite structures containing natural cellulose fibers include such articles as flowerpots, moldings, railroad ties, furniture, marine piers, acoustic insulation, packaging and other building and consumer products.

Many of these articles contain natural cellulose fibers or other fibrous components and a polymer component, which may be a polyolefin (polyethylene, polypropylene) or poly vinyl chloride in the form of fibers or flakes. Polypropylene is a polymer component often used in the automotive industry. The conventional method for producing these articles is to mold, using heat and pressure, a natural cellulose fiber/polymer mixture as in the case of wood/polyethylene composites. Another method is to mold a non-woven or multi-layered structure, which contains the natural cellulose fiber and a binder polymer as well as any mineral fillers and colorants, into a desired product. The application of heat and pressure in molding fuses the binder polymer and natural cellulose fiber or other fibrous component of the admixture or non-woven together. A unified composite article is formed with tensile, stiffness, impact and surface properties necessary for the desired end uses. If the binder polymer is used in sufficient quantity the natural cellulose fiber may be completely encapsulated by the polymer. These molded structures may be up to 50 weight percent (weight %) binder polymer.

Changes in environmental regulations are increasing the need for compostable and biodegradable composites. One of the limitations of the articles described above is their lack of biodegradability when composted, which is due to the nature of the binder polymer used. In the past polyethylene and polypropylene, as well as poly vinyl chloride, epoxides and phenolics have been used in this type of natural cellulose fiber composite. In composting environments olefins, poly vinyl chloride, epoxides and phenolics do not biodegrade readily.

Thus, there exists a need in the art for a biodegradable, compostable, moldable composite article having the structural properties of the existing composites that could be disposed of in a conventional composting landfill at the end of its useful life. Additionally, there is an ongoing conservation need to utilize components that are produced from renewable resources. Accordingly, it is to the provision of such that the present invention is directed.

SUMMARY OF THE INVENTION

The present invention is a composite structure that is useful to produce articles having a varied range of density and stiffness in order to be suitable for their intended use including automotive door panels and acoustic insulation. The term composite structure as used herein is defined as a non-woven web or fabric that has been subjected to heat and pressure to form a molded non-woven article. The composite structure is made from a combination of materials including natural cellulose fibers, binder fibers of cellulose esters and aliphatic-aromatic copolyesters, fillers such as mineral based fillers or reinforcing fillers, and colorants such as pigments or dyes. More specifically, the present invention is a composite structure comprising (a) from about 50 to about 90 weight percent of a natural cellulose fiber; (b) from about 10 to about 50 weight percent of a binder fiber component; (c) from 0 to about 20 weight percent of a filler; and (d) from 0 to about 8 weight percent of a dye or pigment. The binder fiber component comprises (1) from about 50 to about 99 weight percent of a cellulose ester fiber and (2) from about 1 to about 50 weight percent of an aliphatic-aromatic copolyester. The cellulose ester fiber comprises (i) from about 63 to 100 weight percent cellulose ester, preferably about 72 to 100 weight percent and (ii) from 0 to about 37 weight percent plasticizer, preferably about 0 to about 28 weight percent. The copolyester comprises (iii) a glycol component comprising from about 90 to 100 mole percent 1,4-butanediol and 0 to about 10 mole percent of a modifying glycol and (iv) a diacid component comprising from about 42 to about 50 mole percent terephthalic acid and from about 50 to about 58 mole percent adipic acid.

DESCRIPTION OF THE INVENTION

The present invention overcomes the deficiencies of the prior art by providing a non-woven web and/or composite structure prepared by heat and pressure from a non-woven web. The composite structure results in an article of manufacture that is biodegradable and compostable and is prepared from renewable resources without sacrificing desired physical properties. The article may be in the form of a fiber mat, panel or molding. The non-woven web and/or composite structure comprise:

(a) from about 50 to about 90 weight percent of a natural cellulose fiber;

(b) from about 10 to about 50 weight percent of a binder fiber component comprising:

(1) from about 50 to about 99 weight percent of a cellulose ester fiber comprising:

(i) from about 63 to 100 weight percent cellulose ester, preferably about 72 to 100 weight percent cellulose ester, and (ii) from 0 to about 37 weight percent plasticizer, preferably about 0 to 28 weight percent plasticizer; and (2) from about 1 to about 50 weight percent of an aliphatic-aromatic copolyester fiber comprising:

(iii) a glycol component comprising from about 90 to 100 mole percent 1,4-butanediol and 0 to about 10 mole percent of a modifying glycol and (iv) a diacid component comprising from about 40 to about 60 mole percent terephthalic acid and from about 60 to about 40 mole percent adipic acid;

(c) from 0 to about 20 weight percent of a filler; and (d) from 0 to about 8 weight percent of a dye or pigment.

The weight percents of components (a) to (d) are based on the total weight of the composite structure equalling 100 weight percent The weight percent of (b)(1) cellulose ester fiber and (b)(2) aliphatic-aromatic copolyester fiber are based on the total weight of (b) the binder fiber component equalling 100 weight percent. The weight percent of (i)

cellulose ester and (ii) plasticizer are based on the total weight of (1) the cellulose ester fiber equalling 100 weight percent. The mole percent of (iii) the glycol component is based on a total of 100 mole percent glycol component and the mole percent of the diacid component is based on at total of 100 mole percent diacid component.

The natural cellulose fiber is preferably selected from the group consisting of hemp, sisal, flax, kenaf, cotton, abaca, jute, kapok, papyrus, ramie, coconut (coir), wheat straw, rice straw, hardwood pulp, softwood pulp, and wood flour. More preferably, the natural cellulose fiber is selected from the group consisting of hemp, sisal, flax, kenaf, cotton, jute and coir. A suitable fiber length for the natural cellulose fiber component of this invention would be 0.01 to 10.2 cm.

Preferably, in the composite structure, the natural fiber is present from about 60 to about 75 weight percent, and the binder fiber component is present from about 25 to about 40 weight percent where the total weight percent for all fiber is 100 weight percent. As stated previously, examples of articles of composite construction are well known in the art, for example, as disclosed in U.S. Pat. Nos. 4,474,846, 5,883,025, 6,123,172 and 6,184,272, all of which are incorporated herein by reference in their entirety.

The copolyesters of the present invention are preferably used in binder fibers having the form of a fibrous structure. The binder fibers of the invention may be in the form of unicomponent binder fibers and bicomponent sheaths or other surface segments. Shaped binder fibers may be formed with the tops of the cross-sectional legs capped with binder materials during extrusion.

Bicomponent binder fibers may have a sheath/core, side by side, or other configuration known in the art. The process of preparing and bonding a low melt temperature bicomponent binder fiber is described in detail in U.S. Pat. No. 3,589,956. Binder fibers from this invention are readily blended with other biodegradable fibers such as the cellulose fibers described herein.

The binder fiber component comprises an admixture of the cellulose ester fibers and the aliphatic-aromatic copolyester fibers. Preferably, the cellulose ester fibers are present from about 58 to about 99 weight percent, more preferably about 88 to about 98 weight percent, and the copolyester fibers are present from about 1 to about 42 weight percent, preferably, about 1 to about 32 weight percent, and even more preferably, about 2 to about 12 weight percent. With the use of a cellulose ester in the binder fiber component, the composite structures consist primarily of fibers produced from renewable resources and are compostable in a suitable composting environment. The admixture of binder fibers may include both relatively high and relatively low melting thermoplastic fibers. In U.S. Pat. No. 4,195,112 to Sheard et al., a process is disclosed exemplifying binder fibers and their dissimilar softening temperatures to increase the stiffness of fabrics. However, this invention provides increased stiffness as well as biodegradability.

The cellulose esters useful in the present invention can be prepared using techniques known in the art or are commercially available, e.g., from Eastman Chemical Company, Inc., Kingsport, Tenn., U.S.A.

The cellulose esters useful in the present invention have at least 2 anhydroglucose rings and typically have between 2 and 5,000 anhydroglucose rings; also, such polymers typically have an inherent viscosity (IV) of about 0.2 to about 3.0 deciliters/gram, preferably about 1 to about 1.5, as measured at a temperature of 25° C. for a 0.5 gram sample in 100 ml of a 60/40 by weight solution of phenol/tetrachloroethane. In addition, the DS/AGU of the cellulose esters useful herein ranges from about 1.5 to about 3.0. Preferably, the ester portion of the cellulose esters of the invention comprise from 2 to 12 carbon atoms. Particularly, preferred esters of cellulose include cellulose acetate (CA), cellulose propionate (CP), cellulose butyrate (CB), cellulose acetate propionate (CAP), cellulose acetate butyrate (CAB), cellulose propionate butyrate (CPB), and the like.

The cellulose diacetate suitable for this present invention preferably has a degree of substitution (D.S.) of between 1.2 and 2.7, a degree of polymerization of between 150 and 400 glucose monomer units, a fiber denier per filament of between 1 and 60, preferably between 1 and 10, and a staple cut fiber length between 0.01 cm and 10.2 cm. An example of cellulose diacetate suitable for use in this invention is CA-398-30 cellulose diacetate produced by Eastman Chemical Company of Kingsport, Tenn.

Particular cellulose esters suitable for use in this invention are CAB 381-20, a cellulose acetate butyrate having a DS of 1.6 butyryl, 0.9 acetyl and 0.5 hydroxyl, and CAP 482-20, a cellulose acetate propionate having a DS of 2.5 propionyl, a DS of 0.3 acetyl, and 0.2 hydroxyl, both of which are also produced by Eastman Chemical Company. DS or D.S. or DS/AGU for the cellulose esters of this invention can be defined as the number of acyl groups per anhydroglucose ring.

The cellulose ester fibers also preferably comprise cellulose esters selected from cellulose diacetate (CA), cellulose acetate butyrate (CAB), and cellulose acetate propionate (CAP). The cellulose ester fibers are preferably plasticized solvent spun cellulose esters or plasticized melt spun cellulose esters, and more preferably plasticized melt spun cellulose esters. The addition of plasticizer, if used, is added during spinning. Suitable cellulosic plasticizers include glycerin esters, phthalates, adipates, citrate esters, oligomeric polyesters, sulfonamides and ethers. Some specific cellulosic plasticizers are diacetin, triacetin and N-ethyl-o, p-toluene sulfonamide. The amount of plasticizer is from 0 to about 37 weight percent based on the total weight of cellulose ester fiber, which includes the cellulose ester and the plasticizer. The plasticized cellulose ester fibers used may have a UV light stabilizer, or thermo-mechanical oxidation stabilizer added.

The preparation of polyesters and copolyesters is well known in the art (U.S. Pat. No. 2,012,267, incorporated herein by reference in its entirety). Such reactions are usually carried out at temperatures from 150° C. to 300° C. in the presence of polycondensation catalysts such as titanium tetrachloride, manganese diacetate, antimony oxide, dibutyl tin diacetate, zinc chloride, or combinations thereof. The catalysts are typically employed in amounts between 10 to 1000 ppm, based on total weight of the reactants. Preparation of aliphatic-aromatic copolyesters is particularly illustrated in U.S. Pat. No. 5,446,079. For the purpose of the present invention, a representative aliphatic-aromatic copolyester is poly(tetramethylene glutarate-co-terephthalate) containing 30 mole percent terephthalate. This polyester is produced when dimethylglutarate, dimethyl terephthalate, and 1,4-butanediol are heated at 200° C. for 1 hour then at 245° C. for 0.9 hour under vacuum in the presence of 100 ppm of Ti present initially as $Ti(O^iPr)_4$.

Aliphatic-aromatic copolyesters useful in the present invention preferably may contain one or more dicarboxylic acids selected from the group consisting of the following diacids: malonic, succinic, glutaric, adipic, pimelic, azelaic, sebacic, fumaric, 2,2-dimethyl glutaric, suberic, 1,3-cyclopentane-dicarboxylic, 1,4-cyclohexanedicarboxylic, 1,3-cyclohexanedicarboxylic, diglycolic, itaconic, maleic, 2,5-norbornanedicarboxylic, ester forming derivatives thereof, and combinations thereof; and preferably may contain one or more diols selected from the group consisting of ethylene glycol, propylene glycol, 1,3-propanediol, 2,2-dimethyl-1,3-propanediol, 1,3-butanediol, 1,4-butanediol, 1,5-pentanediol, 1,6-hexanediol, 2,2,4-trimethyl-1,6-hexanediol, thiodiethanol, 1,3-cyclohexanedimethanol, 1,4-cyclohexanedimethanol, 2,2,4,4-tetramethyl-1,3-cyclobutanediol, diethylene glycol, triethylene glycol, tetraethylene glycol, a $C_{10}$–$C_{1000}$ poly(ethylene glycol), a $C_8$–$C_{1000}$ poly(tetramethylene glycol), and combinations thereof.

A preferred glycol includes 1,4-butanediol; preferred dicarboxylic acids include adipic acid, glutaric acid and succinic acid. Adipic acid is more preferred.

The aliphatic-aromatic copolyester fibers preferably comprise the glycol component of at least about 95 mole percent 1,4-butanediol, more preferably 100 mole percent, and the diacid component of about 42 to about 46 mole percent terephthalic acid and about 54 to about 58 mole percent of adipic acid. The aliphatic-aromatic copolyester of particular usefulness in the present invention having these compositional characteristics is Eastar Bio™ GP Co-polyester available from Eastman Chemical Company of Kingsport, Tenn.

The mineral based filler or reinforcing fiber useful in component (c) of the invention are selected from the group consisting of aluminum oxide, talc, calcium sulfate, calcium carbonate, clay, aluminosilicates (kaolin), silicon dioxide, carbon fibers or glass fibers.

The pigments, colorants and dyes useful are, for example, titanium dioxide, iron oxides, carbon black and any dye or pigment suitable for cellulose ester plastics and cellulose. The fillers, reinforcing fibers, dyes, pigments and colorants used, while possibly not biodegradable, are for the most part mineral based or could be chosen to be environmentally friendly.

The composite structures of the invention are resin/fiber composite structures and may be produced on existing non-wovens machinery. One production method is by blending the natural cellulose fibers and binder fibers together into a non-woven web, carding the fibers into mats and, if needed, to further distribute the fibers, cross-lapping and needling the carded mats. The use of multi-layers or the orienting (or cross-lapping) of the carded mats may be used to increase the uniformity of the carded mats or to provide or minimize the directionality of strength properties in the molded articles produced from the carded mats. Needling can be used to increase density of a single layer of the carded mat, to lock together and/or increase the density of several layers of material before molding, or to orient fibers in the single or multi-layer mat to the Z direction. Once the desired mat is formed, the mat could be stored until needed for molding. With the application of heat and pressure, the carded mat can be formed into a composite structure that retains the desired shape upon cooling. The mats can be formed into 2 or 3 dimensional shapes. Sufficient pressures and temperatures of the present invention are in the temperature range from 140 deg. C. to 180 deg. C. and pressure range from 20 to 276 bar. U.S. Pat. No. 4,568,581, to Peoples Jr. describes the mechanical process for preparing and molding fibrous mats similar to the process described herein. The composite structures produced are also compatible with both compression molding and injection over molding to produce 3-D shaped articles with relative ease.

The non-woven webs of the invention comprise non-woven fabric or non-woven felt.

The articles produced from the composite structures may have a varied range of density and stiffness in order to be suitable for their intended use. For example, articles produced for acoustic insulation would not have the same density or stiffness requirements as articles produced for automotive door panels. For articles requiring lower stiffness and density, a simplified procedure is used wherein the blended, carded non-woven web is bonded together with lower heat and lower pressure and then held until ready for cutting and molding into the desired shapes. Preparation of the mats useful in this invention could be by continuous processes performed on conventional non-woven industrial equipment.

In many uses for the present invention, the appearance of the finished articles is important. The composite structures may be over molded with a suitable polymer or bonded to a foil, film or cloth. With the choice of the proper mixture fibers in the binder fiber component, the bonding of these coverings to the composite structure could be easily achieved without additional adhesive. The composite structures will also accept an embossed pattern applied in the mold or applied after molding.

In this invention, composting is defined as biodegradation within a specified time frame as the result of the direct interaction of microorganisms (i.e. bacteria and fungi) and/or their enzymes with various substrates such as leaves, paper, wood and certain organic polymers. The rate of biodegradation can be measured by ASTM Standard Method D5338 "Standard Test for Determining the Aerobic Biodegradation of Plastic Materials Under Controlled Composting Conditions"; ASTM Standard Method D6340 "Standard Test for Determining Aerobic Biodegradation of Radiolabeled Plastic Materials in Compost Environment; DIN (German) Standard Method v54900 "Vornorm on Compostability of Plastic Materials"; ISO 14855 "Evaluation of the Ultimate Aerobic Biodegradability and Disintegration of Plastics under controlled Compost Conditions-Method by Analysis of Released Carbon Dioxide"; and ISO 5059 "Evaluation of the Disintegration of Plastic Materials under Defined Composting Conditions".

This invention can be further illustrated by the following examples of preferred embodiments thereof, although it will be understood that these examples are included merely for purposes of illustration and are not intended to limit the scope of the invention unless otherwise specifically indicated. The starting materials are commercially available unless otherwise indicated.

EXAMPLES

Example 1

Comparative Example

A molded board was prepared from cellulose diacetate staple fiber (0.6 to 0.7 cm staple cut, 1.6 denier per filament) and paper grade flax tow (25% shive content, Canadian flax from Ecusta Fibers, Winkler Manitoba, Canada) cut to 0.6–0.8 cm in length. A combination of fibers containing 71.4 weight % of flax and 14.3 weight % cellulose diacetate and 14.3 weight % triethyl citrate plasticizer was formed. The plasticizer (triethyl citrate) was added as a 6.5 weight % solution with isopropyl alcohol. The plasticizer solution saturated mat was allowed to dry under ambient conditions overnight to evaporate the isopropyl alcohol. The plasticized material was then pressed in a Dake static press in a 12.7 cm×12.7 cm square mold at 150 deg. C. for 30 minutes at 34.5 bar. The resulting board was approximately 0.3 cm thick and, although it appeared to be well internally bonded this board showed only a very slight increase in stiffness over a 100 percent flax fiber pressed at the same conditions.

Example 2

Comparative Example

This is a comparative example for the case with no cellulose ester component and without additional external plasticizer addition. A molded board was prepared from Eastar-Bio™ ¼ staple cut fiber and paper grade flax tow (25% by weight of shive content, 75% by weight of Canadian flax from Ecusta Fibers, Winkler Manitoba, Canada) cut to ¼ inch length. The mixture of fibers was 80 weight % flax and 20 weight % Eastar-Bio™ fiber. The above combination was formed into a mat of fibers. This material was then pressed in a PHI static press in a 25.4 cm by 25.4 cm square mold at 150 deg. C. for 600 seconds at 34.5 bar. The resulting board was approximately 0.32 cm thick and well internally bonded. This board showed a noticeable increase in flexibility over Example 1 and over the 100-weight % flax boards pressed as in Example 1.

In Examples 1 and 2, pressed composite boards were made that exhibited increased internal bonding and stiffness over all. However, the use of solvent spun cellulose diacetate fibers as in Example 1 requires the use of a plasticizer, which has a strong affinity for the flax fiber and makes plasticization of the cellulose diacetate a difficult and time consuming process. Excess plasticizer must be used which can lead to plasticizer migration out of the board as the board ages. The use of plasticizer with cellulose fibers in a pressed matrix is documented in U.S. Pat. No. 5,766,752 ("High Pressure Laminates Made With Paper Containing Cellulose Diacetate") and in U.S. Pat. No. 5,922,451 ("Plasticized Sheets, Laminates Made From Such Sheets, And Process For Preparing Such Laminates"). In Example 2 although a very well internally bonded board was made with an aliphatic-aromatic copolyester and without a cellulose ester component, the resulting board was not very rigid and suitable rigidity is necessary for moldings of this nature. To address these shortcomings a series of designed experiments were performed.

Example 3

Example of the Invention

This is the initial designed experiment in the series mentioned above. To address the problem of plasticization of the cellulose diacetate, melt spun cellulose fibers were utilized in this experiment. These fibers were melt spun from compounded cellulose diacetate plastic pellets produced by the Eastman Chemical Company. The resulting melt spun fibers contained 18 weight % triacetin plasticizer and were 4.6 denier per filament. In this designed experiment, total fiber content was composed of flax fiber and binder fiber. The weight % of binder fiber is referred to in the tables and figures below as "Total filler". The flax fiber used was paper grade flax tow (25% by weight of shive content, 75% by weight of Canadian Flax from Ecusta Fibers, Winkler Manitoba, Canada). The binder fiber had a fraction of cellulose diacetate melt spun fibers (CA), which is referred to in the tables and figures below as "Comp#", and melt spun Eastar Bio™ fibers having a 2.5 to 4.0 denier per filament. All fibers were cut to a length of 0.6 to 0.7 cm.

TABLE 3-1

Experimental Design for Example 3

| | Example 3A | Example 3B | Example 3C |
|---|---|---|---|
| Flax Fiber (wt % of total fiber) | 72.5 | 72.5 | 72.5 |
| Binder Fiber (wt % of total fiber) "Total filler" | 27.5 | 27.5 | 27.5 |
| CA (wt % fraction of binder) "Comp#" | 80 | 90 | 100 |
| Eastar Bio ™ (wt % fraction of binder) | 20 | 10 | 0 |
| | **Example 3D** | **Example 3E** | **Example 3F** |
| Flax Fiber (wt % of total fiber) | 80 | 80 | 80 |
| Binder Fiber (wt % of total fiber) "Total filler" | 20 | 20 | 20 |
| CA (wt % fraction of binder) "Comp#" | 80 | 90 | 100 |
| Eastar Bio ™ (wt % fraction of binder) | 20 | 10 | 0 |
| | **Example 3G** | **Example 3H** | **Example 3I** |
| Flax Fiber (wt % of total fiber) | 65 | 65 | 65 |
| Binder Fiber (wt % of total fiber) "Total filler" | 35 | 35 | 35 |
| CA (wt % fraction of binder) "Comp#" | 80 | 90 | 100 |
| Eastar Bio ™ (wt % fraction of binder) | 20 | 10 | 0 |

In this experiment the individual sample fibers were blended together in a Waring blender to achieve intimate blending of the fibers. These blended fibers were hand laid in a 25.4 by 25.4 cm square mold and pressed in the PHI press at 150 deg. C. and 34.5 bar for 30 minutes.

TABLE 3-2

Resulting weight after pressing for Example 3

| Sample ID | Binder fiber wt % "Total filler" | Sample wt (after pressing) (g) |
|---|---|---|
| Example 3A | 27.5 | 132.16 |
| Example 3B | 27.5 | 131.09 |
| Example 3C | 27.5 | 129.81 |
| Example 3D | 20 | 126.19 |
| Example 3E | 20 | 128.47 |
| Example 3F | 20 | 126.96 |
| Example 3G | 35 | 134.43 |
| Example 3H | 35 | 133.39 |
| Example 3I | 35 | 130.64 |

TABLE 3-3

Tensile and Stiffness results for Example 3

| Sample Id | Board Wt g | Break Force g | Modulus g | Tensile Index Nm/g |
|---|---|---|---|---|
| Example 3A | 132.16 | 31881 | 6315610 | 5.77 |
| Example 3B | 131.09 | 38340 | 6532227 | 6.92 |
| Example 3C | 129.81 | 32001 | 6958330 | 5.55 |
| Example 3D | 126.19 | 33939 | 6491889 | 6.41 |
| Example 3E | 128.47 | 22610 | 4916660 | 4.21 |
| Example 3F | 126.96 | 20464 | 3757283 | 3.85 |
| Example 3G | 134.43 | 36526 | 7355346 | 6.47 |

TABLE 3-3-continued

Tensile and Stiffness results for Example 3

| Sample Id | Board Wt g | Break Force g | Modulus g | Tensile Index Nm/g |
|---|---|---|---|---|
| Example 3H | 133.39 | 47466 | 8615511 | 8.41 |
| Example 3I | 130.64 | 48217 | 7957410 | 8.39 |

Example 4

Example of the Invention

A molded board was prepared from melt spun cellulose diacetate, the same fiber as described in Example 3, staple cut to 5 cm, and melt spun Eastar-Bio™, the same fiber as described in Example 3, and paper grade flax tow (25% by weight shive content) cut to approximately 5 cm to 10 cm in length. A mixture containing 70 weight % of paper grade flax tow (25% shive content, Canadian Flax from Ecusta Fibers, Winkler Manitoba, Canada), 25 weight % of cellulose diacetate fiber, and 5 weight % of Eastar-Bio™ film were blended together in a carding machine manufactured by the Eastman Chemical Company. The above combination was formed by hand into a 25.4×25.4 cm mat of fibers in a square aluminum mold. The matrix was then pressed in a static press at 165 deg. C. for 15 minutes at approximately 1 bar. This resulted in the formation of a 25.4×25.4×0.89 cm lofty composite structure with an apparent density of 0.17 g/cc. The resulting board was well internally bonded, with good loft. This board showed a marked increase in apparent stiffness over 100 percent flax fiber pressed at the same conditions.

Example 5

Example of the Invention

A molded board was prepared from melt spun cellulose diacetate, the same fiber as described in Example 3, staple cut to 5 cm, and melt extruded (melt spun) Eastar-Bio™, the same fiber as described in Example 3, and paper grade flax tow (25% shive content, Canadian Flax from Ecusta Fibers, Winkler Manitoba, Canada) cut to approximately 5 cm to 10 cm in length. A mixture containing 55 weight % of flax, 35 weight % of cellulose diacetate fiber, and 10 weight % of Eastar-Bio™ were blended together in a carding machine manufactured by the Eastman Chemical Company. The above combination was formed by hand into a 25.4×25.4 cm mat of fibers in a square aluminum mold. The matrix was then pressed in a Dake static press at 165 deg. C. for 15 minutes at approximately 1 bar. This resulted in the formation of a 25.4×25.4×0.85 cm lofty composite structure with an apparent density of 0.18. The resulting board was well internally bonded, with good loft.

Examples 4 and 5 demonstrate that combinations of binder and flax fibers can produce low apparent density composite boards that are well internally bonded. This type of structure could be well suited for use in sound insulation or other high bulk applications.

Example 6

A molded board was prepared from melt spun cellulose diacetate, the same fiber as described in Example 3, staple cut to 5 cm, and melt spun Eastar-Bio™, the same fiber as described in Example 3, and paper grade flax tow (25% by weight shive content, Canadian Flax from Ecusta Fibers, Winkler Manitoba, Canada) cut to approximately 5 cm to 10 cm in length. A mixture containing 55 weight % of Flax, 35 weight % of cellulose diacetate fiber, 10.00 weight % of Eastar-Bio™ aliphatic-aromatic copolyester were blended together in a carding machine manufactured by the Eastman Chemical Company. The above combination was formed by hand into a 13 cm×13 cm mat of fibers in a square aluminum mold. This composite board was molded starting at room temperature 25 deg C. and 1 bar pressure, heating was applied and sample was held at 1 bar pressure until the temperature reached 165 degrees C. (heating rate 8 degrees per minute). At 165 deg C. pressure was increased to 138 bar and the sample was cooled under pressure to 35° C. (cooling rate 13.5° C. per minute). The resulting board had an apparent density of 1.03 and was well internally bonded and rigid with glossy surfaces.

Example 7

Example Of the Invention

A molded board was prepared from melt spun cellulose diacetate, the same fiber as described in Example 3, staple cut to 5 cm, and melt spun Eastar-Bio™, the same fiber as described in Example 3, and paper grade flax tow (25% shive content) cut to approximately 5 cm to 10 cm in length. A mixture of 60 weight % grams of paper grade flax tow (25% shive content, Canadian Flax from Ecusta Fibers, Winkler Manitoba, Canada), 35 weight % of cellulose diacetate fiber, and 5 weight % of Eastar-Bio™ aliphatic-aromatic copolyester were blended together in a laboratory-carding machine manufactured by the Eastman Chemical Company. The above combination was formed by hand into a 13 cm×13 cm mat of fibers in a square aluminum mold. The matrix was then pressed in a static press at 165 deg. C. for 5 minutes at approximately 103 bar. The resulting board had an apparent density of 1.04 g/cc, and was well internally bonded with glossy surfaces.

Example 8

Example of the Invention

A molded board was prepared from melt spun cellulose diacetate, the same fiber as described in Example 3, staple cut to 5 cm, and melt spun Eastar-Bio™ aliphatic-aromatic copolyester, the same fiber as described in Example 3, and paper grade flax tow (25% by weight shive content) cut to approximately 5 cm to 10 cm in length. A mixture of 70 weight % of paper grade flax tow (Canadian Flax from Ecusta Fibers, Winkler Manitoba, Canada), 25 weight % of cellulose diacetate fiber, and 5.0 weight % of Eastar-Bio™ film were blended together in a carding machine manufactured by the Eastman Chemical Company. The above combination was formed by hand into a 13 cm×13 cm mat of fibers in a square aluminum mold. The matrix was then pressed in a Dake static press at 165 deg. C. for 5 minutes at approximately 103 bar. The resulting board had an apparent density of 0.92 g/cc and was well internally bonded with glossy surfaces.

Example 9

A molded board was prepared from melt spun cellulose diacetate, the same fiber as described in Example 3, staple cut to 5 cm, the same fiber as described in Example 3, and paper grade flax tow (25% shive content) cut to approximately 5 cm to 10 cm in length. A mixture of 60.0 weight % of paper grade flax tow (25% shive content, Canadian Flax from Ecusta Fibers, Winkler Manitoba, Canada), and 40.0 weight % of cellulose diacetate fiber were blended together in a carding machine manufactured by the Eastman Chemical Company. The above combination was formed by hand into a 13 cm×13 cm mat of fibers in a square aluminum mold. The matrix was then pressed in a Dake static press at 165 deg. C. for 10 minutes at approximately 103 bar. The resulting board had an apparent density of 1.07, was well internally bonded, and was rigid with glossy surfaces.

Example 10

Example of the Invention

A set of molded composite boards was prepared from melt spun cellulose diacetate fiber, melt spun Eastar-Bio™, and Flax fiber. The binder fibers, cellulose diacetate and Eastar-Bio™, were staple cut to 5 cm in length at a weight ratio of 9:1 cellulose diacetate to Eastar-B™ film. This binder fiber blend was combined with paper grade flax tow (25% by weight shive content) cut to approximately 5 cm to 10 cm in length at a weight ratio of 6:4. The sample was blended on a 50.8 cm carding machine manufactured by CMC Even-Feed. The carded fiber bats were needled on a fiber locker needle punch machine manufactured by James Hunter at a needled density of 125 punches per cm. The resulting needle punched bats were cut on a die cutter manufactured by Atlas-Sandt to 5 cm×25.4 cm in size. The prepared strips of bat were cut to 5 cm×10 cm and were placed into a steel mold. From two to eight strips of the batting were molded at a time, in the mold within a static press at 165 deg. C. for 10 minutes at approximately 103 bar.

TABLE 10-1

Example 10 Data

| | 2 layers of bat | 4 layers of bat | 6 layers of bat | 8 layers of bat |
|---|---|---|---|---|
| Thickness (cm) | 0.246 | 0.414 | 0.617 | 0.706 |
| Weight (g) | 15.01 | 27.89 | 39.20 | 48.22 |
| Apparent Density (g/cc) | 1.22 | 1.35 | 1.27 | 1.37 |

Example 11

Example of the Invention

An experimental set of molded composite boards was produced with differing natural cellulose fibers. Description of fibers utilized is contained in Table 11-1.

TABLE 11-1

Data on the Commercial Natural Cellulose Containing Fibers.[a]

| Commercial Name | Type of fiber | Botanical Name of plant | Growing area |
|---|---|---|---|
| COTTON | Seed Hair | *Gossypium* sp. | United States, Asia, Africa |
| COIR | Seed Hair | *Cocos nucifera* | Tropics, India, Mexico |
| FLAX | Bast | *Linum usitatissimum* | North and South Temperate Zones |
| HEMP | Bast | *Cannabis Sativa* | China |
| JUTE | Bast | *Corchorus capsularis*; *C. olitorius* | India |
| KENAF | Bast | *Hibiscus cannabinus* | India, Iran, South America |

TABLE 11-1-continued

Data on the Commercial Natural Cellulose Containing Fibers.[a]

| Commercial Name | Type of fiber | Botanical Name of plant | Growing area |
|---|---|---|---|
| SISAL | Leaf | *Agave sisalana* | Haiti, Java, Mexico, South Africa |

[a]Kirk Othmer, Encyclopedia of Chemical Technology, Fourth Edition, Volume 10, 1993

The natural fibers chosen for this work were: flax, coir, sisal, jute, kenaf, raw cotton and hemp fibers. These fibers were prepared by coarse chopping to an approximate length of 0.7 cm. The fibers were mixed with cellulose ester melt spun fibers and melt spun Eastar-Bio™ fibers, also approximately 0.7 cm in length, to the combinations and ratios shown in table 11-2 below. The cellulose ester fibers were cellulose diacetate (CA), cellulose acetate butyrate (CAB) or cellulose acetate propionate (CAP). Each of these lab scale experimental samples was formed from mixtures of the coarsely chopped fiber. The sample of fibers for each part of the example were bloomed together in small batches in a commercial Waring, 4 liter, 3 speed blender. Blooming was done with high speed setting for 5 seconds per batch. The bloomed fibers were then hand laid in a 13×13×2.5 cm aluminum mold with silicone coated release paper between the fibers and the flat surfaces of the mold (silicone side facing the fibers). Light compression with no heating was used to facilitate filling of the mold. The filled mold was placed in a heated static press at 150° C. and 138 bar for 5 minutes and then cooled under pressure to 35° C. The cooling time was 5–8 minutes.

The composition of the examples below is 60 weight % natural cellulose fiber and 40 weight % total binder fiber. The binder fiber composition is 92.5 weight % cellulose ester fiber and 7.5 weight % biodegradable polyester fiber.

TABLE 11-2

Example 11 Composites Compositions

| Example number | Natural Cellulose Fiber | Cellulose Ester fiber | Biodegradable Polyester Fiber |
|---|---|---|---|
| Example 11-1 | Flax | CA | Eastar Bio ™ |
| Example 11-2 | Flax | CAB | Eastar Bio ™ |
| Example 11-3 | Flax | CAP | Eastar Bio ™ |
| Example 11-5 | Jute | CA | Eastar Bio ™ |
| Example 11-6 | Jute | CAB | Eastar Bio ™ |
| Example 11-7 | Jute | CAP | Eastar Bio ™ |
| Example 11-9 | Kenaf | CA | Eastar Bio ™ |
| Example 11-10 | Kenaf | CAB | Eastar Bio ™ |
| Example 11-11 | Kenaf | CAP | Eastar Bio ™ |
| Example 11-13 | Sisal | CA | Eastar Bio ™ |
| Example 11-14 | Sisal | CAB | Eastar Bio ™ |
| Example 11-15 | Sisal | CAP | Eastar Bio ™ |
| Example 11-17 | Coir | CA | Eastar Bio ™ |
| Example 11-18 | Coir | CAB | Eastar Bio ™ |
| Example 11-19 | Coir | CAP | Eastar Bio ™ |
| Example 11-21 | Hemp | CA | Eastar Bio ™ |
| Example 11-22 | Hemp | CAB | Eastar Bio ™ |
| Example 11-23 | Hemp | CAP | Eastar Bio ™ |
| Example 11-25 | Cotton | CA | Eastar Bio ™ |
| Example 11-26 | Cotton | CAB | Eastar Bio ™ |
| Example 11-27 | Cotton | CAP | Eastar Bio ™ |

TABLE 11-3

Testing Results Data for Example 11 Composites

| | FLAX | JUTE | KENAF | SISAL | COIR | HEMP | COTTON |
|---|---|---|---|---|---|---|---|
| E@MXLD (Joules) | | | | | | | |
| CA | 0.089 | 1.430 | 0.176 | 3.518 | 3.410 | 1.255 | 4.298 |
| CAB | 1.644 | 0.183 | 0.159 | 4.185 | 3.849 | 2.330 | 4.298 |
| CAP | No Data | 0.167 | 1.653 | 3.196 | 5.506 | 0.916 | 4.155 |
| Fctr ENRGY (Joules) | | | | | | | |
| CA | 2.549 | 5.028 | 3.157 | 8.345 | 7.868 | 4.065 | 8.147 |
| CAB | 5.234 | 6.913 | 3.574 | 10.186 | 9.719 | 6.819 | 9.678 |
| CAP | No Data | 4.869 | 3.930 | 9.514 | 8.221 | 4.644 | 6.079 |
| MaxLoad (kg) | | | | | | | |
| CA | 88.533 | 48.723 | 72.234 | 102.370 | 93.810 | 56.286 | 115.269 |
| CAB | 64.788 | 79.152 | 68.599 | 115.269 | 112.572 | 88.826 | 115.269 |
| CAP | No Data | 67.426 | 53.296 | 115.269 | 115.269 | 61.387 | 80.149 |
| Thickness (cm) | | | | | | | |
| CA | 0.186 | 0.217 | 0.199 | 0.211 | 0.219 | 0.191 | 0.221 |
| CAB | 0.171 | 0.217 | 0.197 | 0.209 | 0.218 | 0.216 | 0.264 |
| CAP | No Data | 0.231 | 0.221 | 0.215 | 0.229 | 0.215 | 0.240 |
| Density $g/cm^2$ | | | | | | | |
| CA | 1.41 | 1.26 | 1.35 | 1.31 | 1.25 | 1.45 | 1.27 |
| CAB | 1.36 | 1.25 | 1.33 | 1.31 | 1.23 | 1.29 | 1.06 |
| CAP | 1.30 | 1.20 | 1.19 | 1.27 | 1.20 | 1.21 | 1.15 |

[b]Testing data from ASTM Standard test method designation: D3763-00 High Speed Puncture Properties of Plastics Using Load and Displacement Sensors E@MXLD is energy to maximum load point. FctrENRGY is energy at fracture of sample. MaxLoad is the maximum load value achieved.

The composites from Example 11 were composted by in accordance with DIN Pilot Scale Disintegration testing. For all samples complete mineralization occured within 20 weeks.

TABLE 11-4

Composting Data from Composites produced in Example 11

ATTACHMENT OF ORGANISMS TO SUBSTRATE

| DRUM | SAMPLE ID | SAMPLE DESCRIPTION | 4 WEEKS | 8 WEEKS | 12 WEEKS | 16 WEEKS | 20 WEEKS |
|---|---|---|---|---|---|---|---|
| 2 | EXAMPLE 11-1 | fiber board | good | good | good | excellent | |
| 3 | EXAMPLE 11-2 | fiber board | good | good | good | excellent | |
| 5 | EXAMPLE 11-3 | fiber board | fair | good | excellent | NA | NA |

FRAGMENTATION/DISINTEGRATION OF SAMPLE

| DRUM | SAMPLE ID | SAMPLE DESCRIPTION | 4 WEEKS | 8 WEEKS | 12 WEEKS | 16 WEEKS | 20 WEEKS |
|---|---|---|---|---|---|---|---|
| 2 | EXAMPLE 11-1 | fiber board | none | none | fair | good | Complete |
| 3 | EXAMPLE 11-2 | fiber board | none | none | fair | good | Complete |
| 5 | EXAMPLE 11-3 | fiber board | none | none | fair | good | Complete |

NA = Data not available

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A non-woven web or composite structure comprising:

(a) from about 50 to about 90 weight percent of a natural cellulose fiber;

(b) from about 10 to about 50 weight percent of a binder fiber component comprising:

(1) from about 50 to about 99 weight percent of a cellulose ester fiber comprising:

(i) from about 63 to 100 weight percent cellulose ester, and (ii) from 0 to about 37 weight percent plasticizer; and (2) from about 1 to about 50 weight percent of an aliphatic-aromatic copolyester fiber comprising:

(iii) a glycol component comprising from about 90 to 100 mole percent 1,4-butanediol and 0 to about 10 mole percent of a modifying glycol wherein the total mole percentages of glycol equal 100 mole percent; and (iv) a diacid component comprising from about 40 to about 60 mole percent terephthalic acid and from about 60 to about 40 mole percent adipic acid wherein the total mole percentages of dicarboxylic acid equal 100 mole percent;

(c) from 0 to about 20 weight percent of a filler; and (d) from 0 to about 8 weight percent of a dye or pigment, wherein the weight percentages of components (a)-(d) are based on the total weight of said non-woven web or said composite structure.

2. The non-woven web or composite structure of claim 1 wherein said dicarboxylic acid component of said aliphatic-aromatic copolyester fiber comprises 42 to about 50 mole percent terephthalic acid and from about 50 to about 58 mole percent adipic acid.

3. The non-woven web or composite structure of claim 1 wherein said natural cellulose fibers are selected from the group consisting of hemp, sisal, flax, kenaf, cotton, abaca, jute, kapok, papyrus, ramie, coconut, wheat straw, rice straw, hardwood pulp, softwood pulp, and wood flour.

4. The non-woven web or composite structure of claim 3 wherein said natural cellulose fibers are selected from the group consisting of hemp, sisal, flax, kenaf, cotton, jute, and coconut.

5. The non-woven web or composite structure of claim 1 wherein said component (a) is present in the amount of 60 to about 75 weight percent and component (b) is present in the amount of 25 to about 40 weight percent.

6. The non-woven web or composite structure of claim 1 wherein said binder fiber component is an admixture of the cellulose ester fibers and the aliphatic-aromatic copolyester fibers.

7. The non-woven web or composite structure of claim 1 wherein said cellulose ester fibers of component (b)(1) are present in the amount of about 58 to about 99 percent.

8. The non-woven web or composite structure of claim 7 wherein said cellulose esters fibers of component (b)(1) are present in the amount of about 88 to about 98 percent.

9. The non-woven web or composite structure of claim 1 wherein said aliphatic-aromatic copolyester esters fibers of component (b)(2) are present in the amount of about 1 to about 32 percent.

10. The non-woven web or composite structure of claim 9 wherein said aliphatic-aromatic copolyester esters fibers of component (b)(2) are present in the amount of about 2 to about 12 percent.

11. The non-woven web or composite structure of claim 1 wherein said cellulose ester fibers of component (b)(1) comprise cellulose ester selected from the group consisting of cellulose diacetate, cellulose acetate butyrate, and cellulose acetate propionate.

12. The non-woven web or composite structure of claim 11 wherein said cellulose ester fibers of component (b)(1) are selected from the group consisting of plasticized solvent spun cellulose esters and plasticized melt spun cellulose esters.

13. The non-woven web or composite structure of claim 12 wherein said cellulose esters are plasticized with plasticizers selected from the group consisting of glycerin esters, phthalates, adipates, citrate esters, oligomeric polyesters, sulfonamides, and ethers, diacetin, triacetin, and N-ethyl-o, p-toluene sulfonamide.

14. The non-woven web or composite structure of claim 1 comprising fillers or reinforcing fiber selected from the group consisting of aluminum oxide, talc, calcium sulfate, calcium carbonate, clay, aluminosilicates (kaolin), silicon dioxide, carbon fibers, glass fibers, and microbeads.

15. The non-woven web or composite structure of claim 1 comprising one or more of pigments, colorants and dyes.

16. The non-woven web or composite structure of claim 15 wherein one or more of said pigments, colorants and dyes are selected from the group consisting of titanium dioxide, iron oxides, and carbon black.

17. The non-woven web or composite structure of claim 11 wherein said cellulose diacetate has a degree of substitution of between 1.2 and 2.7 and a degree of polymerization of between 150 and 400 glucose monomer units.

18. The non-woven web or composite structure of claim 17 wherein fiber made from the cellulose diacetate of claim 17 has a denier per filament of between 1 and 60 and a staple cut fiber length between about 0.01 cm and 10.2 cm.

* * * * *